US007189676B2

(12) United States Patent
Bourdelais et al.

(10) Patent No.: US 7,189,676 B2
(45) Date of Patent: Mar. 13, 2007

(54) CROSSLINKED COPOLYMER DYE-RECEIVING LAYER

(75) Inventors: Robert P. Bourdelais, Pittsford, NY (US); Cheryl J. Brickey, Webster, NY (US); Timothy J. Giarrusso, Rochester, NY (US); Carol Ann McCarthy, North Brookfield, MA (US)

(73) Assignee: Eastman Kodak Company, Rochester, NY (US)

( * ) Notice: Subject to any disclaimer, the term of this patent is extended or adjusted under 35 U.S.C. 154(b) by 172 days.

(21) Appl. No.: 10/828,685

(22) Filed: Apr. 21, 2004

(65) Prior Publication Data

US 2005/0239651 A1 Oct. 27, 2005

(51) Int. Cl.
*B41M 5/38* (2006.01)

(52) U.S. Cl. ..... 503/227; 427/146; 427/385.5; 428/32.39

(58) Field of Classification Search .. 428/32.39–32.52; 503/227
See application file for complete search history.

(56) References Cited

U.S. PATENT DOCUMENTS

| | | | | |
|---|---|---|---|---|
| 4,621,271 | A | 11/1986 | Brownstein | |
| 4,695,286 | A | 9/1987 | Vanier et al. | |
| 4,740,497 | A | 4/1988 | Harrison et al. | |
| 4,927,803 | A | 5/1990 | Bailey et al. | |
| 5,317,001 | A | 5/1994 | Daly et al. | |
| 5,427,847 | A | 6/1995 | Zawada | |
| 6,309,734 | B1 * | 10/2001 | Taniguchi et al. | 428/195.1 |
| 6,521,308 | B1 | 2/2003 | Bourdelais et al. | |
| 6,566,024 | B1 | 5/2003 | Bourdelais et al. | |
| 6,653,061 | B2 | 11/2003 | Rieger et al. | |

* cited by examiner

*Primary Examiner*—Bruce Hess
(74) *Attorney, Agent, or Firm*—Paul A. Leipold

(57) ABSTRACT

The invention relates to a dye image receiver sheet comprising a dye-receiving layer comprising a cross-linked copolymer of polyester and a lubricator polymer, wherein said polyester component of said cross-linked copolymer is present in an amount of between 75% and 99% by weight.

33 Claims, No Drawings

CROSSLINKED COPOLYMER DYE-RECEIVING LAYER

FIELD OF THE INVENTION

This invention relates to elements used in thermal dye transfer, and more particularly to a polyester co-polymer dye image-receiving layers for such elements.

BACKGROUND OF THE INVENTION

In recent years, thermal transfer systems have been developed to obtain prints from pictures, which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with an element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271.

Dye-receiving elements used in thermal dye transfer generally include a support (transparent or reflective) bearing on one side thereof a dye image-receiving layer, and optionally additional layers. The layer comprises a polymeric material chosen from a wide assortment of compositions and should have good affinity for the dye. Dyes must migrate rapidly into the layer during the transfer step and become immobile and stable in the viewing environment. One way to immobilize the dye in the receiving element is to transfer a laminate layer from the donor element to the receiver after the image has been generated. The layer must also not stick to the hot donor during the printing process, otherwise the final image will be damaged due to either the donor or receiver tearing while peeling apart after the printing step. One way to prevent donor-receiver sticking is to apply an overcoat layer or to add release agents to the receiver layer. The overcoat would require a separate coating step which increases manufacturing costs of the element and addition of release agents increases the media costs.

U.S. Pat. No. 5,317,001 relates to thermal dye transfer to a receiver element. The layer is described as comprising a water-dispersible polyester. These materials are aqueous coatable and were found to provide good image-receiving layer polymers because of their effective dye-compatibility and receptivity. However, there is a problem with this material in that severe donor-receiver sticking occurs during the printing process.

U.S. Pat. No. 5,427,847 relates to the wax transfer of dyes to a receptor sheet. The receptor sheet comprises a mixture of a wax coating having a Tg below 25 degrees C. and a polymeric material which is used in a wax transfer process, and not a thermal dye transfer process. In addition, the weight ratio of wax to polymer is described to be from 2:1 to 12:1, whereas the amount of wax in the receiving layer of the present invention is relatively small.

Polycarbonates (the term "polycarbonate" as used herein means a carbonic acid and a diol or diphenol) and polyesters have been suggested for use in image-receiving layers. Polycarbonates (such as those disclosed in U.S. Pat. Nos. 4,740,497 and 4,927,803) have been found to possess good dye uptake properties and desirable low fade properties when used for thermal dye transfer. As set forth in U.S. Pat. No. 4,695,286, bisphenol-A polycarbonates of number average molecular weights of at least about 25,000 have been found to be especially desirable in that they also minimize surface deformation that may occur during thermal printing.

U.S. Pat. No. 5,317,001 (Daly et al.) describes a thermal dye transfer receiving element utilizing an aqueous dispersible polyester. While the dye transfer layer in Daly et al does result in an excellent image, the use of problematic lubrication is required to prevent dye donor element sticking to the dye-receiving layer.

Polymers may be blended for use in the layer in order to obtain the advantages of the individual polymers and optimize the combined effects. For example, relatively inexpensive unmodified bisphenol-A polycarbonates of the type described in U.S. Pat. No. 4,695,286 may be blended with the modified polycarbonates of the type described in U.S. Pat. No. 4,927,803 in order to obtain a receiving layer of intermediate cost having both improved resistance to surface deformation which may occur during thermal printing and to light fading which may occur after printing. A problem with such polymer blends, however, results if the polymers are not completely miscible with each other, as such blends may exhibit a certain amount of haze. While haze is generally undesirable, it is especially detrimental for transparent labels. Blends that are not completely compatible may also result in variable dye uptake, poorer image stability, and variable sticking to dye donors.

PROBLEM TO BE SOLVED BY THE INVENTION

There is a need for a dye-receiving layer capable of receiving thermally transferred dyes that has dye density greater than 1.5 while avoiding dye donor sticking during the transfer of thermal dyes.

SUMMARY OF THE INVENTION

It is an object of the invention to provide a receiver element for thermal dye transfer processes with a dye image-receiving layer that is water-coatable.

It is another object to provide a receiver element for thermal dye transfer processes, which will not stick to the donor during the thermal printing process.

It is a further object to provide a receiver element for the thermal dye transfer process that will give good uptake of the dye.

It is another object of the invention to provide a receiver element substantially free of polymeric waxes.

These and other objects of the invention are accomplished by a dye image receiver sheet comprising a dye-receiving layer comprising a cross-linked copolymer of polyester and a lubricator polymer, wherein said polyester component of said cross-linked copolymer is present in an amount of between 75% and 99% by weight.

ADVANTAGEOUS EFFECT OF THE INVENTION

The invention provides a layer capable of achieving high density without dye donor sticking. In one preferred embodiment, the invention provides improved image quality, including more realistic flesh tones, for packaging materials, particularly pressure sensitive labels

DETAILED DESCRIPTION OF THE INVENTION

The invention has numerous advantages over prior practices in the art. The invention provides a layer that allows for excellent image formation, high density and avoids dye donor sticking without the need for lubrication chemistry. Prior art thermal dye transfer receiving layers require lubrication chemistry such as waxes or fluorinated polymers to reduce the unwanted dye donor sticking. By providing a layer comprising a copolymer that contains a dye-receiving polymer and a lubrication polymer, high image density can be achieved without dye donor sticking. Further, copolymers are advantaged to polymer blends that are utilized in prior art dye-receiving layers as the copolymer does not suffer from dispersion problems, and coating rheology problems associated with polymer blends.

The invention also provides a cross-linked copolymer system that is improved for coating and adhesion to substrates compared to prior art dye-receiving layer systems that are not cross-linked. Further, cross-linking of the copolymer system provides an increase in scratch resistance, which allows images to be utilized for pressure sensitive labels for the labeling consumer goods. Consumer goods labels frequently encounter abrasion during packaging, shipment and stocking. Labels that are abrasion resistant maintain image quality and thus the appearance of the label. Further, the copolymer is selected to have excellent dye uptake and to provide a compliant layer adjacent the dye donor element to improve printing efficiency and remove any small thickness variations which have been shown to cause printing defects.

Since the materials utilized in the invention can be constructed in an aqueous dispersion subsequent coating of the invention materials significantly reduces undesirable emission of solvents into the environment and reduces any unwanted residual solvents in the dye receiving layer. Residual solvents in the dye receiving layer may accumulate in packaging materials and may have an unpleasant odor when removed from the packaging material by consumers.

Recently there has been a trend in the marketing of mass consumer items to try to localize the marketing to separately approach smaller groups. These groups may be regional, ethnic, gender, age, or special interest differentiated. In order to approach these different groups, there is a need to provide packaging that is specifically directed to these groups. Traditional printing of packaging materials are generally suited for very long runs of material and to form shorter runs or to provide rapid changes in packaging is impossible or very expensive. We have found thermal dye transfer materials that are suitable for packaging uses. Further, recently there has become available rapid thermal dye transfer apparatus suitable for short runs of material. The combination of a low cost label material with the processing apparatus available for rapid short and long runs of material has resulted in the opportunity for thermal dye transfer material to be utilized as labels in packaging materials. Thermal dye transfer materials that have properties such as flexibility, low cost, and the ability to flex and bend has resulted in materials satisfactory and suitable for packaging. By combining the advantages of thermal dye transfer printing, mainly excellent image quality, short run economics and ability to print from a digital file, thermal dye transfer labels provides a digital printing solution to label printers. These and other advantages will be apparent from the detailed description below.

The terms as used herein, "top", "upper", "image side", and "face" mean the side or toward the side of a dye image receiver sheet bearing the dye-receiving imaging layers. The terms "bottom", "lower side", and "back" mean the side or toward the side of the dye image receiver sheet opposite from the side bearing the dye imaging layers. The term used herein "peelable adhesive" or "repositionable adhesive" means an adhesive material that has a peel strength less than 100 grams/cm. The term used herein "permanent adhesive" means as adhesive materials that has peel strength of greater than 100 grams/cm. The term used herein "substrate" means materials that are commonly utilized in the advertising and display industry for the lamination of images. Examples include acrylic sheets, paperboard, wallboard, fabric, cardboard and polymer sheets.

The term used herein "dye donor element sticking" means the tendency of dye donor elements, which typically are thermal dyes coated onto thin oriented polymer, to stick to the dye receiver element. Dye donor element sticking is typically measured by printing high density color patches and making visual observations of the dye donor element sticking to the receiving layer. At the onset of sticking, vertical density lines, sometimes referred to as chatter, are observed down the printed page at a repeatable frequency. As used herein, the term "dye uptake" means the ability of any dye-receiving layer to accept dyes that are printed or thermally transferred. Dye uptake is typically related to the thermal printing temperature, chemistry of the dye-receiving layer, and chemistry of the dyes and the Tg of the dye-receiving layer. As used herein, the term "dye migration" means the tendency of the dyes to move in the dye-receiving layer after printing. Dyes that have a high amount of migration will result in an image becoming fuzzy, less sharp or text becoming fuzzy or the inability of bar code reading equipment to read printed black bar codes. Dye migration is typically related to ambient temperature, dye-receiving layer chemistry, Tg of the dye-receiving layer and amount of plasticizer in the dye-receiving layer.

In order to provide a dye-receiving layer that is capable of efficiently receiving dyes and avoid the need for expensive and problematic lubrication chemistry a dye image receiver sheet comprising a dye-receiving layer comprising a cross-linked copolymer of polyester and a lubricator polymer, wherein said polyester component of said cross-linked copolymer is present in an amount of between 75% and 99% by weight is preferred. The polyester component of the copolymer of the invention provides excellent uptake of dye and excellent dye retention. The lubricator component of the copolymer provides lubrication to resist sticking of dye donor web materials at the pressures and temperatures common during thermal dye transfer. Since the polyester component provides the dye uptake and retention properties, the polyester component of the copolymer is the majority component. Polyester component below 70% by weight of copolymer, the dye uptake and dye retention are reduced to an unacceptably low level, reducing the quality of the printed image. Above, 99.5% by weight of copolymer, little lubrication is provided to thermal dye transfer donor webs, significantly increasing donor web sticking to the receiving layer. A cross-linked copolymer of polyester and lubricator polymer is preferred because cross-linking the copolymer of the invention improves web adhesion, aids in coating and subsequent drying of the coated dye-receiving layer and improves the mechanical properties of the coated, dried dye-receiving layer.

The dye receiver layer of the invention preferably is substantially free of waxes and fluoropolymers. While waxes and fluoropolymers have been shown in the art to reducing sticking of the dye donor elements during thermal dye transfer, the waxes are expensive, difficult to disperse in solution and tend to "bloom" to the surface of the receiver layer changing the lubricity of the dye receiver layer as a function of time. Further, some of the waxes have been shown to create unwanted dispersion defects in the dye receiver layer resulting in poor image quality. Polyester copolymers utilizing lubricator polymers do not suffer from dispersion problems and thus significantly reduce the above problems with waxes and fluoropolymers.

The dye receiver layer of the invention preferably comprises a plasticizer. Plasticizer addition to the dye receiver layer has been shown to increase the dye uptake while not significantly increasing dye donor element sticking during thermal dye transfer. The preferred plasticizer addition by weight of the copolymer is between 1 and 5% by weight. Above 10% addition plasticizer has been shown to significantly increase dye migration in the printed image, which renders the image fuzzy and of lower dye density. Preferred plasticizers utilized in the dye receiver layer utilized in the invention are aliphatic esters and phthalate esters.

The dye receiver layer is preferably capable of forming a thermal image that has a maximum cyan, magenta, and yellow formed black density of greater than 1.5. A black density of less than 1.3, while allowing for a good quality image tends to be viewed as low quality for packaging materials such as pressure sensitive labels, flexible packaging and stand-up pouches. In packaging applications, bar codes are important to retail. Bar codes with black density less than 1.3 are difficult to read and can result in accounting errors during scanning of bar codes. Black dye density is measured on a Status A reflection densitometer. Maximum dye density is created when maximum amounts of yellow, magenta and cyan dyes have been transferred in registration to a 4 $cm^2$ patch in the receiver layer.

The dye receiver layer preferably has a roughness average less than 3.0 micrometers. A smooth dye receiver layer is essential to the quality of a thermal dye transfer image. By providing a dye receiver layer with a roughness average less than 3.0, unwanted image drop-outs caused by uneven contact between the dye donor element and the receiver layer are not formed. Roughness average of the dye receiver layer is measured by TAYLOR-HOBSON Surtronic 3 with 2 micrometers diameter ball tip. The output Ra or "roughness average" from the TAYLOR-HOBSON is in units of micrometers and has a built in cut off filter to reject all sizes above 0.25 mm.

Lubricator polymers utilized in the invention provide lubrication between the cross-linked dye receiver layer and dye donor elements such as 6 micrometer PET. During thermal dye transfer printing of images, test or graphics, a resistive thermal head is brought into contact with dye donor element. Dye is transferred to the dye-receiving layer by thermal heat generated by the resistive head and pressure between the resistive thermal head and the dye-receiving layer. Preferred lubrication polymer, which are in a copolymer with polyester, provide the desired lubrication. In an embodiment of the invention, polyurethane polymer is preferred for a lubrication polymer. Polyurethanes are formed by reacting a polyol with a diisccyanate or a polymer isocyanate in the presence of suitable catalysts and additives. Polyurethane in a copolymer with polyester has been found to provide donor element lubrication during thermal dye transfer, can be formed into a copolymer with polyester, does not interfere with the formation of the dye based image and has design flexibility to provide a target dye receiver layer Tg for high printed dye density. Further, a polyester-based polyurethane polymer achieves a particular balance of strength and flexibility that is desirable for a dye receiving layer. For polyester-based polyurethane polymers useful in the present invention, convenient measures of the strength and flexibility attributes are 100% modulus as an indicator of strength and percent elongation to break as an indicator of flexibility. 100% modulus is defined as the tensile strength measured at 100% elongation and is measured utilizing ASTM D 638. 100% modulus is preferably in the range of 27 to 41 MPa. Elongation to break is preferably in the range of 150–300% and is measured utilizing ASTM D 638.

The polyester-based polyurethane polymer may be made from a variety of polyester polyols and polyisocyanates. When made from difunctional polyester polyols (2 hydroxyl groups per polyester polyol molecule) and diisocyanates, the polymer is typically made by preparing a prepolymer at a stoichiometric ratio of isocyanate groups to hydroxyl groups (NCO/OH ratio) of greater than one, preferably in the range of from 1.3 to 3.0 and optimally in the range of from 1.5 to 2.7. Mixtures of polyols and mixtures of polyisocyanates may be used and it is possible to include other polyfunctional reactive nucleophiles, and also polyols and/or polyisocyanates with functionalities greater than 2. If polyols or polyisocyanates of functionality different than 2 are employed it is especially necessary to control the amounts of reactants having functionality different than 2 and to adjust NCO/OH so as to avoid either excessive chain termination or extensive network formation that could lead to gelation of the pre-polymer.

To aid in dispersibility in water, groups that are hydrophilic, or that can be converted to hydrophilic groups, are customarily chemically incorporated into the pre-polymer. Typical of hydrophilic groups are backbone constituents with pendant polyethylene oxide chains. These act as nonionic stabilizing groups. Commonly used to create anionic stabilizing groups are carboxylic acid or sulfonic acid groups that hang off the prepolymer backbone. These become hydrophilic after salting them with tertiary amines, or the inverse can be done, where backbone or pendant tertiary amino groups can be salted with acids, giving rise to cationic stabilization. However made, the prepolymeric, isocyanate-terminated intermediate is typically dispersed in water or water containing one or more surfactants and right after dispersion is chain extended by reaction of remaining, unreacted isocyanate groups with polyfuctional nucleophiles. When salting is used for stabilization, the prepolymer can be salted before it is dispersed, or the salting amine or acid as the case may be can be placed in the water phase before dispersion. Chain extension increases molecular weight and affords an aqueous dispersion of a polymeric urethane. The chain extender is a di or polyfunctional reactive nucleophile that reacts with unreacted isocyanate groups. Chain extender to unreacted isocyanate group stoichiometry is usually chosen to maximize molecular weight of the polyurethane. The reactive nucleophilic groups in the chain extender can be amino (including hydrazine), hydroxyl, or other reactive groups. Even water can function as a chain extender. Mixtures of chain extenders, or chain extenders with more than one kind of reactive nucleophilic group, for example, an aminoalcohol, can be used.

While polyurethane has been shown to be an excellent lubricator polymer for thermal dye transfer printing of the dye receiver layer and provide a compliant layer adjacent to dye donor elements, other copolymers may be suitable to provide both good dye uptake while reducing dye donor element sticking. Other suitable polyester copolymers for thermal dye transfer printing include polycarbonate, polycyclohexylenedimethylene terephthalate and vinyl modified polyester copolymers.

In one embodiment of the invention, the polyester utilized for the copolymer dye-receiving layer comprises condensation polyesters based upon recurring units derived from alicyclic dibase acids and diols. A polyester derived from derived from alicyclic dibase acids and diols has been shown to provide excellent dye uptake and can be dispersed in an aqueous solution. The preferred polyester copolymer is formed from a water dispersion, which means the diluent or carrier is mainly water. Water dispersions are relative easy to coat, provide excellent film formation to polymer webs and are safer for the environment compared to solvent dispersions of copolymer.

The polymers used in the elements of one embodiment of the invention are condensation type polyesters based upon recurring units derived from alicyclic dibasic acids and diols wherein one or more alicyclic ring containing dicarboxylic acid units with each carboxyl group within two carbon atoms of (preferably immediately adjacent) the alicyclic ring are present and one or more diol units each containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more C1 to C4 alkyl groups. Each of the diols may also optionally be substituted on the aromatic or alicyclic ring, e.g. by C1 to C6 alkyl, alkoxy, or halogen. Among the necessary features of the polyesters for the blends of the invention is that they do not contain an aromatic diester such as terephthalate.

It has been found that balancing the dye uptake properties of polyester with the lubrication polymer allows for excellent dye density without dye donor element sticking. The exact ratio of polyester to lubrication polymer depends upon several important factors such as the dye transfer temperature, printing speed, lubrication chemistry present in the dye donor element and the Tg of the polyester. In one embodiment of the invention the weight % of polyester of the copolymer is greater than 90%. Polyester weight % in the range of 90 to 99% have been found to provide excellent dye uptake and dye stability in the dye-receiving layer in most thermal printing systems. If the heat of the thermal dye printing system is relatively high and the Tg of the polymer is low, then it is understood that the polyester weight % would be between 75% and 90% of the cross-linked copolymer.

The glass transition temperature or Tg of the cross-linked dye receiver layer is an important determining factor in the dye density of the printed image. A high dye-receiving layer Tg tends to have low dye uptake but very low dye donor element sticking. A low dye-receiving layer Tg tends to have high dye uptake but very high levels of unwanted dye donor element sticking. Tg is conveniently measured utilizing the well known measurement technique known as DSC. The preferred dye-receiving layer is between 42 and 72 degrees Celsius, more preferably between 42 and 62 degrees C. A dye-receiving layer having a Tg below 40 degrees C. has been shown to exhibit dye donor sticking. A dye-receiving layer having a Tg greater than 75 degrees C. does not allow the dyes to migrate into the dye receiver layer resulting in low image density. The range of 42 to 62 degrees C. has been found to provide both excellent dye uptake in the cross-linked copolymer of the invention and dye donor element sticking performance utilizing resistive head thermal printers. Most preferably, the Tg of the dye-receiving layer of the invention is about 52 degrees Celsius. Since the measurement of Tg typically contains measurement error of about 2% and manufacturing variability can contribute another 3% of variation, there exist some acceptable range around a Tg of 52 degrees Celsius, hence the term about 52 degrees Celsius.

Cross-linking of the polyester/lubricator copolymer is preferred and has been shown to improve the mechanical properties of the dye receiver layer, improve adhesion to oriented polymer webs compared to polyester/lubricator polymers without a high degree of cross-linking and allow for good film formation during coating of the dye receiver layer. In a preferred embodiment, the lubricator polymer comprises polyurethane and the cross-linking material comprises trimethylolpropane tris(2-methyl-1-aziridine propionate) present in amount of between 0.20 and 0.85 weight % of the cross-linked polymer. Trimethylolpropane tris(2-methyl-1-aziridine propionate) has been shown to be an effective cross-linking material for a polyester/polyurethane copolymer and provides good dye uptake.

The cross-linked copolymer of the invention has a percentage of cross link between 50 and 85%. The percentage of cross-link between the polymer is the number of cites that are cross-linked divided by the total number of possible cross-linked cites. Cross-linking of the polyester copolymer below 40% does not provide the mechanical property and adhesion benefits. Above 90% it has been shown that the rate of dye uptake is reduced.

One of the many benefits of the cross-linked copolymer dye receiver layer is an improvement in scratch resistance of the printed dye receiver layer. Scratch resistance is particularly important during the handling of images or for packaging materials that must withstand the rigors of a packaging operation. The cross-linked copolymer of the invention preferably has a scratch resistance of between 0.1 and 1.0 mN. Scratch resistance is measured by dragging a steel tip with a radius of 5 micrometer across the dye receiver layer at a rate of 10 cm/min. The steel tip is progressively loaded until scratching in the dye receiver layer is first observed. The load for which a scratch in the dye receiver layer is first observed is the recorded load. A scratch resistance less than 0.08 scratches too easily and can easily be damaged during handling of the printed dye receiver image. A scratch resistance greater than 1.1 mN has been shown to unacceptably reduce dye uptake because a dye receiving layer with a scratch resistance greater than 1.1 mN is hard and difficult for the dye to migrate into under typical thermal dye transfer printing.

The cross-linked copolymer dye receiver layer preferably has a surface energy of between 40 and 48 dynes/cm$^2$. Surface energy has been found to be a good indicator of dye donor sticking. Low surface energy dye receiver layers such as PVA and EVA have been shown to be more prone to dye donor sticking. High surface energy dye receiver layers such as acrylic and nylon have been shown to have less dye uptake than low surface energy dye receiver layers. Surface energy between 40 and 48 dynes/$cm^2$ has been shown to provide good dye uptake and low dye donor element sticking.

Since the printing process required web materials to be wound and unwound, the opportunity to generate a static charge on one or more of the webs materials is present. In a preferred embodiment of the invention, the dye-receiving sheet of the invention contains an antistatic material and preferably has a resistivity of less than $10^{11}$ ohms/square. A wide variety of electrically-conductive materials can be incorporated into adhesive layers and/or dye-receiving layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semi-conductive metal halide salts, semi-conductive metal oxide particles, etc. have been described previously. In the most preferred embodiment, the antistat material comprises at least one material selected from the group consisting of tin oxide and vanadium pentoxide.

In another preferred embodiment of the invention antistatic material are incorporated into the pressure sensitive adhesive layers. The antistatic material incorporated into the pressure sensitive adhesive layer provides beneficial static reduction between the dye receiving layer and dye donor elements. Further the antistatic material reduces the static on the label which has been shown to aid labeling of containers in high speed labeling equipment. As a stand-alone or supplement to the carrier comprising an antistatic layer, the pressure sensitive adhesive may also further comprise an antistatic agent selected from the group consisting of conductive metal oxides, carbon particles, and synthetic smectite clay, or multi-layered with an inherently conductive polymer. In one of the preferred embodiments, the antistatic material is metal oxides. Metal oxides are preferred because they are readily dispersed in the thermoplastic adhesive and can be applied to the polymer sheet by any means known in the art. Conductive metal oxides that may be useful in this invention are selected from the group consisting of conductive particles including doped-metal oxides, metal oxides containing oxygen deficiencies, metal antimonates, conductive nitrides, carbides, or borides, for example, $TiO_2$, $SnO_2$, $Al._2O_3$, $ZrO_3$, $In_2O_3$, MgO, $ZnSb_2O_6$, $InSbO_4$, $TiB_2$ $ZrB_2$, $NbB_2$, $TaB_2$, $CrB_2$, MoB, WB, $LaB_6$, ZrN, TiN, TiC, and WC. The most preferred materials are tin oxide and vanadium pentoxide because they provide excellent conductivity and are transparent.

The receiver sheet for the element of the invention may be transparent or reflective, and may be a polymeric, a synthetic paper, or a cellulosic paper support, or laminates thereof. In a preferred embodiment, a cellulose paper support is used. In a further preferred embodiment, a polymeric layer is present between the paper support and the dye image receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer is preferably utilized over this polymeric layer in order to improve adhesion to the dye image-receiving layer. In particular, oriented polymer sheets that have low surface energy such as polypropylene can be improved for dye receiver layer adhesion with the use of a subbing layer. Suitable subbing layers for dye receiving layer adhesion to polymeric web materials are disclosed in U.S. Pat. Nos. 4,748,150; 4,965,238; 4,965,239; and 4,965,241.

In another preferred embodiment of the invention, the dye receiver sheet comprises an oriented polymer. Oriented polymers tend to be thin, strong and smooth sheets that have been shown to be excellent substrates for the dye receiver layer of the invention. Further, dye receiver layer coated oriented polymer sheets can be utilized for packaging applications such as stand-up pouches and snack food packaging. Oriented polymer sheets coated with the dye-receiving layer of the invention can also be used as point of purchase display and signs.

In another preferred embodiment of the invention, the dye receiver sheet comprises a pressure sensitive adhesive. Thermal dye transfer imaging technology can simultaneously print text, graphics, and photographic quality images on the pressure sensitive label. Since the thermal dye transfer imaging layers of the invention are both optically and digitally compatible, text, graphics, and images can be printed using known digital printing equipment such as lasers and CRT printers. Because the thermal dye transfer system is digitally compatible, each package can contain different data enabling customization of individual packages without the extra expense of printing plates or cylinders. Further, printing digital files allows the files to be transported using electronic data transfer technology such as the internet thus reducing the cycle time to apply printing to a package. Thermal dye transfer imaging layers allow competitive printing speeds compared to current ink jet printing methods.

In the field of product labeling and advertising, the ability of the printing technology to reproduce all of the colors in the Pantone color space is important. An example is the reproduction of corporate colors such as candy apple reds or lemon yellows that uniquely identify a product. Prior art printed ink system for labeling have utilized spot colors beyond red, green and blue inks to obtain the desired color. Thermal dye transfer printing systems are typically Pantone color space limited when the thermal dye transfer uses only combinations of yellow, magenta and cyan dyes to form colors. Thermal printing has the advantage that additional color patches, including white, fluorescent, or metallic colors, can be used to improve the color space. At present approximately 70% of Patone color space can be replicated with a yellow, magenta and cyan dye based system. As another option, additional color may be applied to the printed, developed thermal dye transfer formed image or additional color may be under the dye-receiving layer, so that the image can comprise areas of both dye transfer image and areas colored, as background, without thermal dye transfer in order to improve the gamut of the image.

Thus, one preferred method of providing an expanded thermal dye transfer dye gamut is providing a non-neutral color to a layer under the layer, which non-neutral color will show through the transparent layer. By providing non-neutral, or a colored background to or near the top of the substrate of the label, a single color background can be utilized under the thermal dye transfer image of the invention. Further, because the dyes utilized in thermal dye transfer imaging printing systems are semi-transparent, background color can optionally be blended with color formed by thermal dye transfer dyes. An example of a colored background would be, the addition of a candy apple red tint to a top layer of the substrate, adjacent the dye-receiving layer, preferably in or near the top of the pragmatic polymer sheet. By forming a thermal dye transfer image on top of the candy apple red base, the dye gamut of the thermal dye transfer "system" is expanded to include candy apple red. The background color becomes part of the image by not applying the thermal dye transfer dye in certain intended or pre-selected areas and the background color can be eliminated by applying pre-selected one or more thermal dye transfer imaging dyes over the background.

Another preferred method for the expansion of the thermal dye transfer color space is by printing and developing the thermal dye transfer image and subsequently printing color on top of the thermal dye transfer formed image. This method is preferred as printing inks common to the printing industry can be used to expand the color gamut of the thermal dye transfer formed image. Over printing with dye based ink allow color formation with the thermal dye transfer formed dyes thus expanding the color space of the thermal dye transfer dyes. Over printing with pigmented inks, create expanded color without utilizing the native colors of the thermal dye transfer formed image below the pigment printing ink. Overprinting can occur by lithograpic, inkjet, electrophotographic or other printing technologies.

In another embodiment, the base material preferably is printed with indicia. By printing the base material with indicia, the text size limitation of thermal dye transfer is over come as printed text is legible to 2 points. Further, by printing black text on the base material, the thermal dye transfer imaging system utilized for printing can be low contrast, which significantly improves flesh tones. Improved flesh tones, especially on advertising labels has significant commercial value as flesh tones comprising printed inks, characteristic of lithographic printing, are low in quality.

The addition of a fiducial mark to the thermal dye transfer formed image is preferred as the fiducial mark provides a means for die cutting the image to create a label. The addition of a fiducial mark allows the article to be die cut using optical sensors to read the registration of the image. The fiducial mark may be printed on the base material, printed using thermal dye transfer formed images or post process printed using printed inks. In another embodiment, the fiducial mark is created utilizing a mechanical means such as punched hole, mechanical embossing or a partial punched hole to create a topographical difference in the thermal dye transferred formed image. A mechanical fiducial mark allows for mechanical sensors to be used for die cutting, application of a spot printed color or for locating a label on a package during automated labeling.

In another embodiment of the invention, the thermal dye transfer formed image is preferably over laminated with a pre-printed sheet. By pre-printing an over-lamination sheet with images, text or non-neutral color, the color space of the thermal dye transfer formed image is expanded. Further, over laminating can also protects the delicate thermal dye transfer formed image from abrasion, water and handling damage that frequently occurs for packaging labels.

Suitable printing inks for this invention to expand the color gamut of a thermal dye transfer system include solvent based inks and radiation cured inks. Examples of solvent based inks include nitrocellulose maleic, nitrocellulose polyamide, nitrocellulose acrylic, nitrocellulose urethane, chlorinated rubber, vinyl, acrylic, alcohol soluble acrylic, cellulose acetate acrylic styrene, and other synthetic polymers. Examples of radiation cured inks include ultraviolet and electron beam inks. The preferred ink systems for printing indicia are radiation cured inks because of the need to reduce volatile organic compounds associated with solvent based ink systems.

The dye receiver layer of the invention is preferably formed by gravure coating an aqueous dispersion of the polyester/lubricator polymer onto a smooth web material, and drying the dye receiver layer. Gravure coating is preferred because gravure coating has been shown to provide precision delivery of the dye receiver chemistry and is capable of coating very productively. Other coating methods may be utilized. Examples include roll coating, reverse roll coating, curtain coating, hopper coating and blade coating.

The aqueous dye receiver layer dispersion preferably is coated at 10 to 30% solids. Below 8% solids, the dryer length becomes too long and flow after coating, which results in unacceptable image quality is observed. Above 40% solids, the aqueous dispersion is encounters difficulty exiting the gravure cells and results in coverage variation.

The aqueous dispersion of the invention is preferably dried to less than 1% residual water. At 4% residual water, roll blocking between the dried dye receiver layer and the substrate is observed. Some residual water helps maintain the flexibility of the receiver layer during printing. During drying, the dye receiver layer is subjected to heated drying, that is drying over 75 degrees C. The drying helps to speed the cross-linking that is important to film formation and improved mechanical properties.

The aqueous dispersion utilized in the invention preferably contains alcohol. Alcohol addition to the aqueous dispersion in the amount of 3 to 35% by weight of polymers aids in the release of the coated dispersion from the gravure cells, aid in uniform heated drying of the aqueous dispersion and reduces unwanted foaming in the gravure dip tank.

Dye-donor elements that are used with the element of the invention conventionally comprise a support having thereon a dye containing layer. Any dye can be used in the dye-donor employed in the invention, provided it is transferable to the layer by the action of heat. Especially good results have been obtained with sublimable dyes. Dye donors applicable for use in the present invention are described, e.g., in U.S. Pat. Nos. 4,916,112; 4,927,803; and 5,023,228. As noted above, dye-donor elements are used to form a dye transfer image. Such a process comprises image-wise-heating a dye-donor element and transferring a dye image to an element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. When the process is only performed for a single color, then a monochrome dye transfer image is obtained.

Thermal printing heads, which can be used to transfer dye from dye-donor elements to receiving elements of the invention, are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage comprises (a) a dye-donor element, and (b) a element as described above, the element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the element and the process repeated. The third color is obtained in the same manner.

The following examples illustrate the practice of this invention. They are not intended to be exhaustive of all possible variations of the invention. Parts and percentages are by weight unless otherwise indicated.

EXAMPLES

Example 1

This example, a pressure sensitive thermal dye transfer label materials having excellent dye uptake and image formation was created by coating an aqueous dispersion of a polyester/polyurethane copolymer on a pressure sensitive label substrate. This example will demonstrate the utility of a polyester copolymer containing a lubricating polymer for the formation of an image suitable for labeling consumer products. The invention will be compared to a prior art dye receiving layer containing a solvent dispersion of polycarbonate and a copolymer dye receiving layer without the addition of cross linking material.

Biaxially Oriented Polyolefin Pragmatic Sheet:

A composite sheet polyolefin sheet (75 μm thick) (d=0.93 g/cc) consisting of an oriented polypropylene core (approximately 60% of the total sheet thickness), with a homopolymer non-microvoided oriented polypropylene layer on each side of the core layer. The polyolefin sheet had a skin layer consisting of polyethylene. The polypropylene layer adjacent the core layer contained 6% anatase form of $TiO_2$. The thermal imaging layers were applied to the blue tinted polyethylene skin layer.

Pressure Sensitive Adhesive:

Permanent solvent based acrylic adhesive 25 micrometers thick containing 0.62% residual solvent.

Polyester Carrier Sheet:

A 50 micrometer clear PET coated one side with a cross-linked silicone release layer.

Structure of the Label Element of the Example is as Follows:

| |
|---|
| Polypropylene pragmatic sheet |
| Acrylic pressure sensitive adhesive |
| Silicone release coating |
| PET carrier sheet |

Invention Dye Receiver Layer:

An aqueous dispersion of polyester/polyurethane copolymer. The ratio of polyester to polyurethane was 90:10 by weight. Trimethylolpropane tris(2-methyl-1-aziridine propionate) was added at 0.0% (control), 0.70% (invention) and 1.0% (invention) by weight of polyester/polyurethane copolymer to further cross link the copolymer during and after drying. The aqueous polymer was coated with a 125 QCH direct gravure cylinder at 30% solids. 22% IPA by weight of polymer was added to aid in drying and release from the gravure cylinder. The coated 30% solids aqueous dispersion was dried at 80 degrees C. The invention dye receiver had a measured Tg of 52 degrees C.

Control Dye Receiver Layer:

A typical solvent coated polycarbonate dye image-receiving layer was applied to the surface of the polyethylene skin layer at a coverage of 2.7 g/m$^2$. The control dye receiver layer contained unmodified bisphenol-A polycarbonates having a number molecular weight of at least about 25,000 include those disclosed in U.S. Pat. No. 4,695,286 and a typical fluorinated polymer lubricant. The control dye receiver layer had a measured Tg of 47 degrees C.

The above thermal dye transfer label sheets for both the control and invention dye receiver layer were printed on a Kodak 8670 PS Thermal Dye Transfer Printer. Density test targets were printed so that density maximum could be measured with Status A reflection densitometer. Red, green and blue density maximum values for the invention and control dye receiver materials is listed in Table 1 below.

TABLE 1

| | Red Density Maximum | Green Density Maximum | Blue Density Maximum |
|---|---|---|---|
| Control | 1.86 | 1.75 | 1.60 |
| Control (0% cross link) | Dye donor element stick | Dye donor element stick | Dye donor element stick |
| Invention (0.70% cross link) | 1.76 | 1.70 | 1.64 |
| Invention (1.0% cross link) | 1.72 | 1.61 | 1.59 |

As the data in Table 1 indicates, the invention dye-receiving layer containing 0.70% cross link material provide equivalent red, green and blue dye density compared to the control dye-receiving layer containing a lubricant without any dye donor element sticking. Surprisingly, the invention dye-receiving layers were able to resist dye donor element sticking without the need for expensive and problematic lubrication chemistry when the cross-linking material was present at 0.70% and 1.0%. Density measurements for the control material containing 0% cross link were not possible as the dye donor element adhered to the dye receiving layer at the time of printing. The polyurethane component of the copolymer utilized in the invention dye-receiving layer provided the required lubrication when the copolymer was cross linked.

The addition of trimethylolpropane tris(2-methyl-1-aziridine propionate) to further cross link the copolymer, eliminated dye donor element sticking compared to the control dye receiving layer that did not contain cross linking materials. The addition of the cross linking to the invention provided better dye density at the 0.70% level compared to the 1.0% addition level. Cross-linking of the copolymer is thought to also improve dye stability or dye migration in the printed dye-receiving layer while increasing the durability of the dye receiving layer and reducing dye donor element sticking.

The measured Tg of the control dye receiver layer was 47 degrees C. and was 52 degrees C. for the 0.70% cross-linked invention material. Contrary to the prior art, equivalent dye density was obtained with the invention dye-receiving layer compared to the control material. The prior art predicts a reduction in dye density as the Tg of the polymer dye-receiving layer increases. The higher Tg of the invention dye-receiving layer allows for better resistance to dye migration, particularly as ambient temperature approaches the Tg of the dye-receiving layer. This is an important factor as thermal dye transfer images are utilized for packaging labels. Packaging labels typically are exposed to temperatures that are higher than images. Examples include pasteurization of glass beverage bottles, labeling of automotive engine labels and outdoor labeling of recreational sporting goods.

Thermal dye transfer image technology utilized in the example can simultaneously print text, graphics, and photographic quality images on the same label. Since the thermal dye transfer imaging layers of the invention are digitally compatible, text, graphics, and images can be printed using known digital printing equipment such as lasers and CRT printers. Further, printing digital files allows the image files to be transported using electronic data transfer technology such as the internet, thus reducing the amount of time required for a packaging label change. Typically, a packaging label change utilizing the traditional methods of printing plates and cylinders required 10 weeks from concept to finished labels. The invention allows changes to occur in less than 1 hour.

While this example was directed at thermal dye transfer printed images, the dye-receiving layer of the invention has been shown to be a good dye receiver layer for other printing methods utilizing dyes such as ink jet printing or flexographic printing. While ink jet printing and flexographic printing do not utilize a dye donor element avoiding any dye donor element sticking problems, the dye receiving layer chemistry of the invention has good uptake for those printing processes. Finally, while this example was directed at labeling applications, the label element of the invention has utility for consumer printing of images, commercial mounting of images on back boards, bus wrap materials, album pages and the like.

The invention has been described in detail with particular reference to certain preferred embodiments thereof, but it will be understood that variations and modifications can be effected within the spirit and scope of the invention.

What is claimed is:

1. A dye image receiver sheet comprising a substrate and a dye-receiving layer comprising a cross-linked copolymer of polyester and a lubricator polymer comprising polyurethane, wherein said polyester component of said cross-linked copolymer is present in an amount of between 75% and 99% by weight.

2. The dye receiver sheet of claim 1 wherein said polyester comprises condensation polyesters based upon recurring units derived from alicyclic dibase acids and diols.

3. The dye receiver sheet of claim 1 wherein said polyester comprises greater than 90% by weight of said crosslinked copolymer.

4. The dye receiver sheet of claim 1 wherein said dye receiver sheet comprises a thermal transfer dye receiver sheet.

5. The dye receiver sheet of claim 1 wherein said dye receiver has a Tg of between 42 and 62° C.

6. The dye receiver sheet of claim 1 wherein said dye receiver has a Tg of about 52° C.

7. The dye receiver sheet of claim 1 wherein said crosslinked copolymer is formed from a water dispersion.

8. The dye receiver sheet of claim 1 wherein said crosslinked copolymer forms a surface layer of said dye receiver sheet that has a surface energy of between 40 and 48 dynes/cm$^2$.

9. The dye receiver sheet of claim 1 wherein said crosslinked copolymer has a percentage of crosslinking between 50% and 85%.

10. The dye receiver sheet of claim 1 wherein said crosslinked polymer was crosslinked utilizing trimethylolpropane tris (2-methyl-1-aziridine propionate) in amount of between 0.20 and 0.85 weight % of the crosslinked polymer.

11. The dye receiver sheet of claim 1 wherein said crosslinked polymer forms a surface layer of said dye receiver sheet and has a scratch resistance of between 0.1 and 1.0 mN.

12. The dye receiver sheet of claim 1 wherein said sheet has an antistat present in the crosslinked polymer which forms the surface layer of said dye receiver.

13. The dye receiver sheet of claim 1 wherein said sheet comprises an oriented polymer.

14. The dye receiver sheet of claim 1 wherein said sheet comprises an adhesion promoting layer located adjacent said dye-receiving layer.

15. The dye receiver sheet of claim 1 wherein said sheet comprises a pressure-sensitive adhesive.

16. The dye receiver sheet of claim 1 wherein said sheet comprises an oriented polymer adhesively adhered to cellulose paper.

17. The dye receiver sheet of claim 1 wherein said dye receiver layer further comprises a plasticizer.

18. The dye receiver sheet of claim 1 wherein said dye receiver layer is substantially free of waxes and fluoropolymers.

19. The dye receiver sheet of claim 1 wherein said dye receiver layer is capable of forming a thermal image that has a maximum cyan, magenta, and yellow formed black density of greater than 1.5.

20. The dye receiver layer of claim 1 wherein said dye receiver layer has a roughness average less than 3.0 micrometers.

21. The method of forming a dye receiver sheet comprising providing an aqueous dispersion of a copolymer of polyester and a lubricator polymer comprising polyurethane, bringing said aqueous dispersion into contact with a gravure coating roll, coating said aqueous dispersion onto a substrate, drying said aqueous dispersion to form a dye receiver layer, comprising a cross-linked copolymer of polyester and a lubricator polymer comprising polyurethane, wherein said polyester component of said cross-linked copolymer is present in an amount of between 75% and 99% by weight.

22. The method of claim 21 wherein said aqueous dispersion of copolymer has between 10 and 30% solids by weight.

23. The method of claim 21 wherein said aqueous dispersion is heated during drying to form a cross-linked polymer.

24. The method of claim 21 wherein said dye receiver is wound after drying to less than 1% water by weight in said dry receiver layer.

25. The method of claim 21 wherein said aqueous dispersion further comprises alcohol.

26. The method of claim 21 wherein said dye receiver has a Tg of between 42 and 62° C.

27. The method of claim 21 wherein said dye receiver layer comprises a copolymer of polyester and polyurethane.

28. The method of claim 21 further comprising a crosslinked dye receiver layer wherein dye receiver layer was crosslinked utilizing trimethylolpropane tris (2-methyl-1-aziridine propionate) in amount of between 0.20 and 0.85 weight % of the crosslinked polymer.

29. The method of claim 21 wherein said sheet comprises a pressure-sensitive adhesive.

30. The method of claim 21 wherein said dye receiver layer further comprises a plasticizer.

31. An imaged dye receiver sheet comprising a substrate and a dye image receiver sheet comprising a dye-receiving layer comprising a crosslinked copolymer of polyester and a lubricator polymer comprising polyurethane, wherein said polyester component of said crosslinked co polymer is present in an amount of between 75% and 99% by weight having a thermal image thereon, wherein said thermal image has a maximum cyan, magenta, and yellow formed black density of greater than 1.5.

32. The imaged dye receiver sheet of claim 31 wherein said dye receiver has a Tg between 42 and 62 degrees C.

33. The imaged dye receiver sheet of claim 31 wherein said crosslinked copolymer is formed from a water dispersion.

* * * * *